United States Patent [19]

Nakanishi

[11] Patent Number: 5,057,363

[45] Date of Patent: Oct. 15, 1991

[54] MAGNETIC DISPLAY SYSTEM

[75] Inventor: Masayuki Nakanishi, Kanagawa, Japan

[73] Assignee: Japan Capsular Products Inc., Tokyo, Japan

[21] Appl. No.: 457,938

[22] Filed: Dec. 27, 1989

[51] Int. Cl.[5] ..... B43L 1/12

[52] U.S. Cl. ..... 428/321.5; 428/900; 434/409; 446/131; 273/239

[58] Field of Search ..... 428/148, 321.1, 321.5, 428/900; 273/1 M, 239; 446/131; 434/409

[56] References Cited

U.S. PATENT DOCUMENTS 4,232,084 11/1980 Tate ..... 428/321.5

4,536,428 8/1985 Murata et al. ..... 434/409

*Primary Examiner*—Alexander S. Thomas

*Attorney, Agent, or Firm*—Wenderoth, Lind & Ponack

[57] ABSTRACT

A magnetic display system which comprises a display having a non-magnetic substrate and a microcapsule coating layer provided on the substrate, with sealed magnetic particles having an excellently light-absorptive surface characteristic and also sealed non-magnetic particles having an excellent light-reflective characteristic. Both the magnetic and non-magnetic particles are dispersed or dissolved in an oily liquid in the microcapsules. A magnetic device for reversing the position of the light-absorptive magnetic particles and light-reflective non-magnetic particles in the microcapsules is provided. The magnetic device causes a local shift by attraction of the light-absorptive magnetic particles in the microcapsule coating layer of the display to the front side thereof to thereby invert the position of the light-reflective non-magnetic particles in the corresponding areas, thereby forming characters or images.

6 Claims, 3 Drawing Sheets

MAGNETIC DISPLAY SYSTEM

BACKGROUND OF THE INVENTION

1. Field of the Invention

This invention relates to a magnetic display system which utilizes coatings of microcapsules containing light-absorptive magnetic particles and light-reflective non-magnetic particles in a dispersing oily medium and interchanges each cluster of the particles' position within the individual microcapsules for absorption or reflection of light to thereby form a contrast image of brightness and darkness.

2. Description of the Prior Art

As prior art concerning magnetic display systems, there is one in which a transparent plastic sheet is formed over the entire surface with honeycomb-like cavities, each with a dimension of about 2 mm as one side and depth. Each cavity is filled with white a pigment liquid and magnetic particles and is sealed with a transparent sheet to prevent leakage of the filling matter. In this case, a rod-like permanent magnet is shifted over the entire display surface from one end of the back surface of the magnetic display plate to the other, thus bringing magnetic particles in each honeycomb-like cavity toward the back side of the display plate and leaving the white color of the white pigment on the front surface. By moving a rod-like magnetic pen with its writing end in contact with the white surface of the display, magnetic particles in the scribed area are brought to the front surface, thus forming an image.

Another magnetic display system is known which utilizes a non-magnetic substrate coated with a layer of microcapsules containing magnetic particles, and a permanent magnet as a means to form and erase an image.

Of these prior art magnetic display systems, the former forms an image with a shift of magnetic particles in honeycomb-like cavities from the back surface to the front surface. Thus, it is impossible to obtain an image resolution sharper than the cavity size. In addition, the provision of a mold for forming the honeycomb-like cavity and the step of sealing the white pigment dispersed in liquid together with magnetic particles can not be readily attained. Further, it is technically substantially impossible to make a display board providing honeycomb-like cavities in a size as large as a blackboard. Further, it is technically extremely difficult to seal the white pigment dispersed in liquid together with magnetic particles in honeycomb-like cavities provided over the entire surface of such large size display. Further, it is also not easy to provide a small-size display, like a pocket-size display, due to the construction noted above. Therefore, the former display system can find only limited applications. At any rate, for formation of an image the total amount of magnetic particles in each honeycomb-like cavity are shifted from the back surface to the front surface, and therefore it is impossible to form a sharp image. Besides, when the display board is held vertically for a lengthy time, after formation of an image, magnetic particles in the honeycomb-like cavity tend to sink to the bottom thereof. Further, it is difficult to provide a display board having a free size.

The latter magnetic display system is far superior to the former display system with the white pigment and magnetic particles dispersed in liquid sealed in a honeycomb-like cavity of a plastic molding in that the quality of images that can be formed is very superior, the polarity orientation of magnetic particles can be changed with a very slight magnetic flux density and a display having a desired size can be readily obtained. However, this system requires magnetic particles of nickel, or alloys thereof, capable of providing a surface gloss and having a flakier shape (i.e., a flat and elongated shape) than those of ferrite or ordinary iron oxide obtainable by mass production, as well as readily capable of polarization, because it is necessary to provide a strong contrast between light absorption when the particles are orientated vertically and light reflection when the particles are orientated horizontally. This leads to increased costs.

SUMMARY OF THE INVENTION

The present invention seeks to solve the problems inherent in the above two different prior art magnetic display systems.

According to the present invention, there is provided a magnetic display system comprising a display including a non-magnetic substrate and a microcapsule coating layer provided on the substrate and having sealed magnetic particles having an excellently light-absorptive surface characteristic and also sealed non-magnetic particles having an excellent light-reflective character. Both the particles are dispersed or dissolved in an oily liquid. A magnetic device includes a permanent magnet and serves both as a means for causing a shift by attraction of the light-absorptive magnetic particles in the microcapsules toward the back side of said display over the entire surface of said microcapsule coating layer and, as a result, causing a shift of light-reflective non-magnetic particles toward the front surface of said display, and a means for causing a local shift by attraction of the light-absorptive magnetic particles having been shifted by attraction from the back side of said display to the front side thereof to thereby invert the position of light-absorptive non-magnetic particles in corresponding areas, thereby forming characters of images.

According to the present invention, a multi-pole magnetized permanent magnet is used as the magnetic device for causing the shift by attraction of the light-absorptive magnetic particles in the microcapsules toward the back side of said display over the entire surface of the microcapsule coating layer.

According to the present invention, a rod-like permanent magnet, which is magnetized in the length direction, is further used as said magnetic means for causing shift by attraction of magnetic particles in microcapsules in local areas of the display toward the front surface thereof for forming characters or like images on the display surface.

Microcapsules, in which magnetic particles having a light-absorptive character and non-magnetic particles having a highly light-reflective surface characteristic are sealed together with a dispersion liquid, are coated on display board, and elongated strips of ferrite-containing plastic material having a width of several centimeters are formed from one end to the other end on the back surface of the display. By moving a megnetic device which is multi-pole magnetized in the length direction, relative to the display in a direction perpendicular to the direction of the magnetization pitch, magnetic particles in the microcapsules are shifted by attraction toward the back side of the display, while non-magnetic particles in the microcapsules are shifted toward the front surface of the display. As a result, the entire display surface shows the color of reflected light from the non-magnetic particles.

Then, by contacting a desired portion of the display surface, the entirety of which is providing the color of reflection, with a tip of a pen-like permanent magnet, for instance, which is two-pole magnetized, magnetic particles in microcapsules in the contacted area is shifted by attraction toward the front side of the display, while non-magnetic particles in that area are shifted toward the back side. In this way, black characters or like images may be formed on the display front surface with light absorption by magnetic particles. For erasing characters or like images, the back surface of the display is swept from one end to the other end with the multi-pole magnetized magnetic means. As a result, the characters or the like are erased, so that the entire display surface again provides the color of reflected light from the non-magnetic particles.

DETAILED DESCRIPTION OF THE PREFERRED EMBODIMENTS

Embodiments of the present invention will be described with reference to the accompanying drawings.

Figure 1:
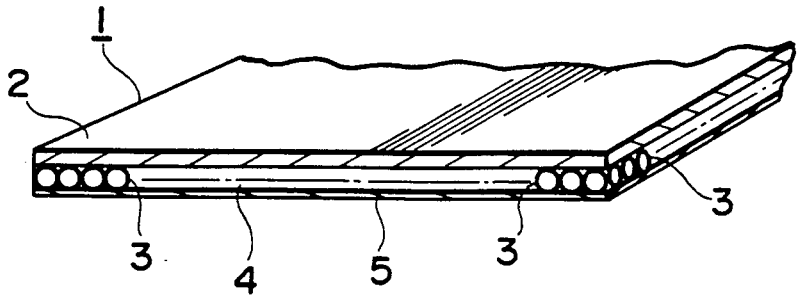
FIG. 1 is a schematic perspective view showing a display according to the present invention.

Referring to FIG. 1, there is shown a display generally designated at numeral 1. This display 1 comprises a non-magnetic substrate 2, microcapsule coating layer 4 provided on the entire back surface of the substrate 2 and consisting of microcapsules 3, in which light-absorptive magnetic particles 10 and light-reflective non-magnetic particles 11 consisting of a pigment or a dye are sealed, and a protective layer 5 provided on the side of the microcapsule coating layer 4 opposite the substrate 2 to prevent rupture of the microcapsules 3 by frictional pressure. The non-magnetic substrate 2 may be made of any material and have any shape so long as it is a transparent non-magnetic member. In this embodiment, the substrate 2 is made from a transparent sheet.

Figure 2:
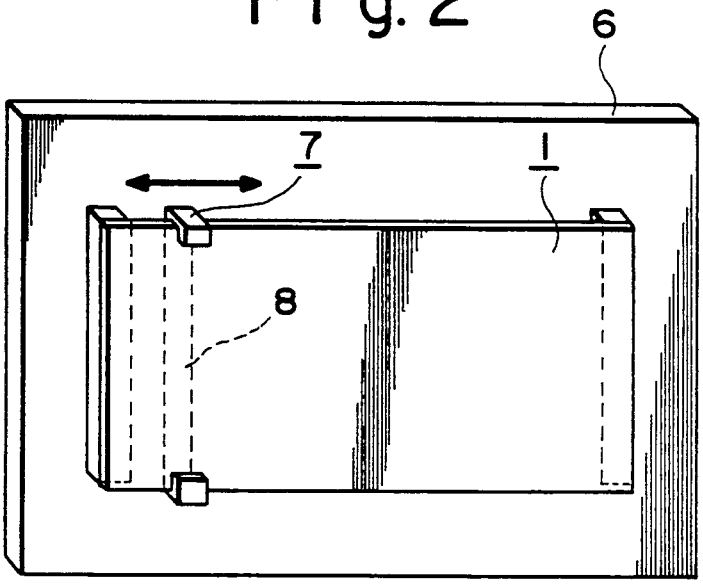
FIG. 2 is a schematic perspective view showing the display according to the present invention and a magnetic means mounted over the entire area of the display for causing a shift by attraction of magnetic particles in microcapsules to the lower portion of each microcapsule, i.e., to the back side of the display.

FIG. 2 shows the display 1 provided on the surface of a support 6.

Now, the microcapsules 3, in which light-absorptive magnetic particles 10 and light-reflective non-magnetic particles 11 consisting of a pigment or a dye are sealed, will be described in detail.

Figure 5:
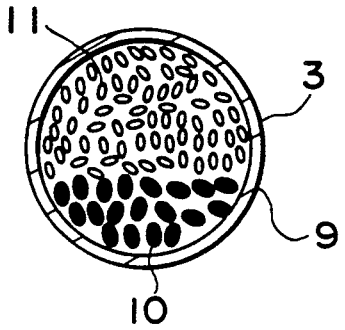
FIG. 5 is an enlarged-scale sectional view showing a microcapsule.

FIG. 5 is an enlarged-scale view showing the microcapsule 3. As an example, for the magnetic particles 10 having an excellent light-absorptive characteristic were used black iron oxide particles ($Fe_3O_4$) with an average diameter of 0.3–0.5 micron, and as the non-magnetic particles 11 having an excellent light-reflective characteristic and consisting of a pigment or a dye was used white titanium oxide ($TiO_2$).

The magnetic and the non-magnetic particles 10 and 11 were dispersed by 3% and 17% by weight, respectively, in magnaflux oil.

Then, an aqueous solution containing 11% of Gum Arabic was added to an aqueous solution containing 11% of gelatin and having an isoelectric point corresponding to pH 6. The blended solution was agitated to obtain an aqueous solution of a polymer for a microcapsule shell. The system was elevated in tempetature to 50° C., and then an aqueous solution containing 21% of sodium hydroxide was added to adjust the pH of the system to 9. The dispersion liquid containing the magnetic and the non-magnetic particles 10 and 11 was added to the aqueous solution system of the polymer, and the resultant system was agitated until dispersion liquid drops of 100–400 microns were produced.

Thereafter, the pH was gradually reduced to 4.0 to cause precipitation of concentrated gelatin/Gum Arabic rubber liquid at the interface of the dispersion liquid containing the magnetic and the non-magnetic particles 10 and 11. Then, the precipitated film was caused to undergo gelation by lowering the temperature of the system. Then, the skin was hardened by adding an aqueous solution containing 25% of glutaraldehyde, thus obtaining the microcapsules 3, in which the magnetic and the non-magnetic particles 10 and 11 were sealed.

In the above method, the microcapsules 3 were obtained as slurry containing about 20% microcapsules 3. The water content of the slurry was then reduced to one half, thus obtaining a condensed slurry with a water content of 35%. To this condensed slurry were added 0.05 parts of an aqueous solution containing polyvinyl alcohol 17%, 0.175 parts of an acryl emulsion with a concentration of 30%, grain size controller agent and slight amounts of de-foaming agent, thus obtaining a coating liquid of the microcapsules 3.

This coating liquid was coated using a curtain coater on the non-magnetic substrate 2, consisting of a 100-micron thick polyethylene telephthalate sheet, to a wet thickness of about 400 microns, thus obtaining a sheet of the display 1.

FIG. 2 shows the display 1 with a magnetic device 7 mounted on support 6. The magnetic device 7 serves to shift, by attraction, the magnetic particles 10 in individual microcapsules 3 in the microcapsule coating layer 4 coated on the back surface of the display 1 toward the back side thereof over the entire surface thereof. In this instance, an elongated or strip-like permanent magnet 8 is used as the magnetic device 7. The magnetic device 7 is moved as a slider over the back surface of the display 1 from one end thereof to the other end. By so doing, the magnetic particles 10 in the microcapsules 3 are shifted by attraction to the back side of the display 1.

Figure 3:
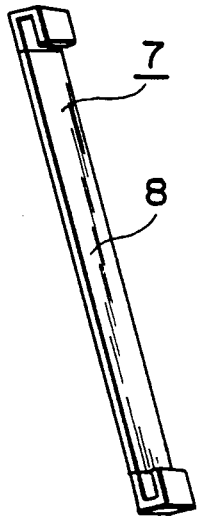
FIG. 3 is a perspective view, on an enlarged scale, showing the magnetic means shown of FIG. 2.

The permanent magnet 8 used for the magnetic device 7 shifts, by attraction, the magnetic particles 10 in the microcapsules 3. It has a strip-like shape as shown in FIG. 3. The magnetic device 7 is by no means limited, so long as it is a permanent magnet with a surface flux density of about 100 Gauss or above. In this embodiment, a multi-pole magnetized rubber magnet is used as the permanent magnet 8. Such a multi-pole magnetized permanent magnet 8 was manufactured as follows.

80% of anisotropic barium ferrite with a long axis dimonsions of 2–4 microns and 20% of vulcanized rubber were kneaded together and then molded using an extruder into a sheet having a thickness of about one millimeter. Then, the anisotropic particles of barium ferrite were orientated using a field orientater such that their long axis was directed in the magnetizing direction. Then, saturated magnetism was applied to the sheet using a multi-pole magnetizer, thus producing a rubber magnet magnetized on both sides of the sheet at a pitch of about three microns and with a remanent magnetic flux density (Br) of 1,200 Gauss. The sheet was then cut with the rubber magnet parallel to the magnetizing direction to a width of about 20 millimeters, thus obtaining the permanent magnet 8 of this embodiment.

Figure 4:
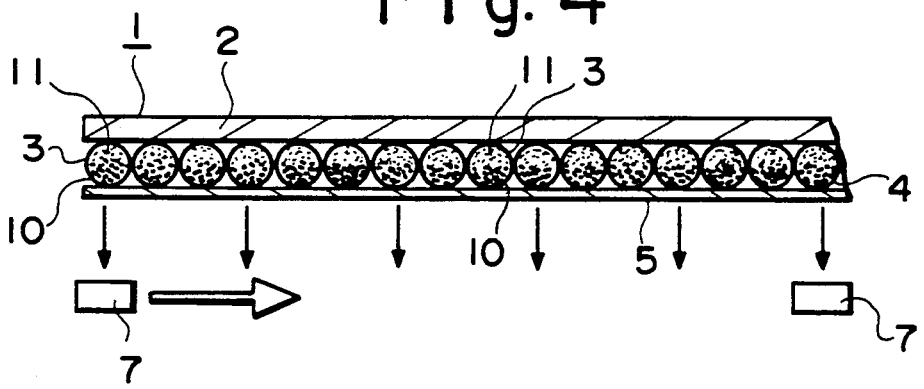
FIG. 4 is a schematic view showing a state, in which magnetic particles in microcapsules are shifted by attraction to the lower portion of each microcapsule, i.e., to the back side of the display over the entire surface thereof.

FIG. 4 shows the state inside the microcapsules 3 with the magnetic particles 10 shifted downwardly and the non-magnetic particles 11 shifted upwardly when the magnetic device 7 consisting of the multi-pole megnetized strip-like permanent magnet 8 is moved over the back surface of the display 1 from one end thereof to the other end. FIG. 5 shows, on an enlarged-scale, the microcapsule 3 with a transparent shell 9, in which the magnetic particles 10 are shifted downwards and the non-magnetic particles 11 are shifted upwards.

When the display 1 in the state, in which the magnetic and the non-magnetic particles 10 and 11 in the microcapsules 3 are shifted upwardly and downwardly, respectively, is looked at from the front side, the entire surface of the display 1 has a white color due to the reflection of incident light by the non-magnetic particles 11.

Figure 6:
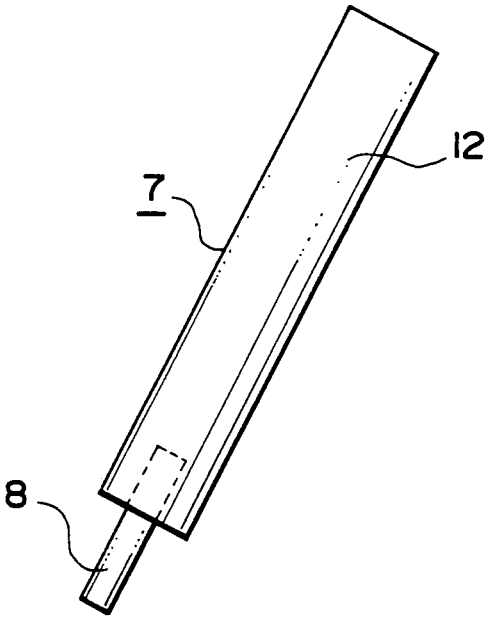
FIG. 6 is a schematic view showing a magnetic means for forming characters or images on the display surface.

FIG. 6 shows a magnetic device 7 for forming characters or like images on the surface of the display 1 for displaying characters or like images. It is a two-pole magnetized rod-like permanent magnet 8 mounted on a holder 12.

Figure 7:
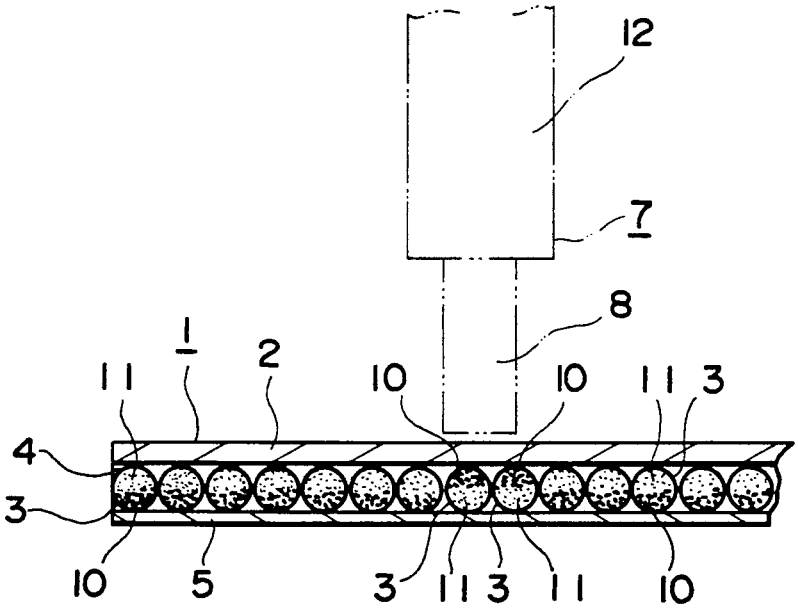
FIG. 7 is a schematic view explaining interchanges in microcapsules when forming characters or images on the display surface.
Figure 8:
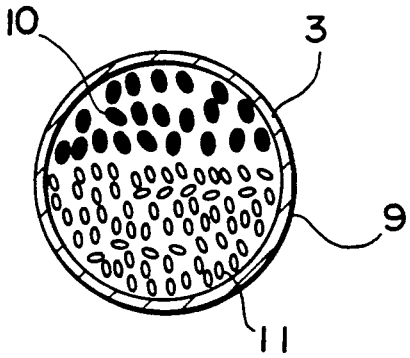
FIG. 8 is an enlarged-scale sectional view showing a microcapsule in the state shown in FIG. 7.

FIG. 7 shows how the magnetic and the non-magnetic particles 10 and 11 are shifted upwardly and downwardly, respectively, in the microcapsules 3 in areas where characters or images are drawn by tracing on the surface of the non-magnetic substrate 2 of the display 1, the entirely of which is reflecting white the light, with two-pole magnetized rod-like permanent magnet 8 on the holder 12 with the tip of the permanent magnet 8 with a remanent magnetic flux density of 1,200 Gauss in contact with the display 1. FIG. 8 shows, on an enlarged-scale, the microcapsule 3 with its transparent shell 9, in which the magnetic and the non-magnetic particles 10 and 11 are shifted upwardly and downwardly, respectively.

When the portion of the display 1 where the magnetic particles 10 in the microcapsules 3 are shifted upwardly is observed from the front side of the display 1, it is black in color, with incident light absorbed by the magnetic particles 10. It is to be understood that with this display 1 the front surface thereof is primarily white light reflection by the non-magnetic particles 11 consisting of white titanium oxide by the operation shown in FIG. 4, and the same surface is subsequently locally changed to a black color of light absorption by the magnetic particles 10 by the operation shown in FIG. 6, thus displaying characters and like images.

As has been described in the foregoing, with the magnetic display system according to the present invention, magnetic particles having excellent light-absorptive property and non-magnetic particles having excellent light-reflective property in contrast are sealed in microcapsules such that these two different types of particles are dispersed in oil for interchange in position in each microcapsule. These microcapsules are coated as display elements on a non-magnetic substrate to form a display. Positioning of the two different kinds of particles in each microcapsule is primarily effected over the entire display surface by externally applying a magnetic field to the display by a suitable method, and then repositioning of the two different particles is effected locally to display characters or like images. Thus, the magnetic display system according to the present invention has the following very excellent advantages compared to the pertinent magnetic display systems in the prior art.

(1) Since the average diameter of particles forming characters or like images is or the order of a maximum of 200 microns, sharp characters or like images can be displayed.

(2) There are wide scopes of selection available of the light-absorptive magnetic particles and the light-reflective non-magnetic particles which are sealed in the microcapsules, and thus it is possible to obtain cost reduction by utilizing commercially available mass production particles. Further, color display selection is possible with selected color pigments absorbed on the surface of both the different kinds of particles.

(3) The non-magnetic base used as the substrate of the display may be molded or extrusion formed from various transparent materials such as transparent resins, inorganic glass, butyral-protected glass and fiber glass.

(4) The size of the display can be freely selected by the method of coating the microcapsule coating layer. Further, a desired cut size can be obtained after coating by selecting a material capable of being cut for the substrate. Thus, free selection of the display size is possible, from large sizes for outdoor purposes to small sizes such as cards to be accommodated in pockets.

(5) Compared to the prior art displays, the materials used, particularly the magnetic and non-magnetic particles for image formation, both are strongly light-resistant, and thus it is possible to provide a display system which can be used even under very hard conditions.

(6) The display system is free from air pollution by dry fine particles of aqueous paint, as opposed to the case with a prior art system in which aqueous paint is used for writing characters or the like on a white board. The display system according to the present invention thus can be used as a perfectly clean display system, which can be used for projection of semiconductor chips and in clean rooms required for precision painting.

What is claimed is:

1. A magnetic display system, comprising:

a display comprising a non-magnetic substrate forming a front side, a back side and a microcapsule coating layer on said substrate, said microcapsule coating layer including a plurality of microcapsules, and said microcapsules containing a plurality of magnetic particles having a light absorbing characteristic and a plurality of non-magnetic particles having a light reflecting characteristic, both said magnetic and said non-magnetic particles being disposed in an oily liquid in said microcapsules;

a first magnetic means for causing migration of said light absorbing magnetic particles in said microcapsules toward said back side of said display and migration of said light reflecting non-magnetic particles in said microcapsules toward said front side of said display in an area of said microcapsule coating layer to make said area light reflective from said front side of said display, said first magnetic means comprising a permanent magnet; and a second magnetic means for causing migration of said light absorbing magnetic particles in said microcapsules toward said front side of said display and migration of said light reflecting non-magnetic particles in said microcapsules toward said back side of said display at localized positions in said area of said microcapsule coating layer to make said localized positions light absorbing from said front side of said display for contrast with the light reflective remainder of said area, said second magnetic means comprising a permanent magnet.

2. The magnetic display system of claim 1, wherein said permanent magnet of said first magnetic means is an elongated multipole magnet having a length substantially equal to the width of said display.

3. The magnetic display system of claim 1, wherein said permanent magnet of said second magnetic means is an elongated rod magnetized in the direction of elongation.

4. The magnetic display system of claim 1, wherein said display has a protective layer on said back side for protecting said microcapsule coating layer.

5. The magnetic display system of claim 1, wherein said magnetic particles comprise black iron oxide particles and said non-magnetic particles comprise titanium oxide.

6. The magnetic display system of claim 1, wherein said substrate comprises a polyethylene telephthalate sheet.

* * * * *